United States Patent [19]

Schneider

[11] Patent Number: 4,942,967

[45] Date of Patent: Jul. 24, 1990

[54] BOTTLE RACK COMPONENT AND ASSEMBLY

[76] Inventor: Bernardus J. J. A. Schneider, Zuideindseweg 54, 2645, BH Delfgauw, Netherlands

[21] Appl. No.: 393,645

[22] Filed: Aug. 14, 1989

[51] Int. Cl.[5] ..... A47B 73/00

[52] U.S. Cl. ..... 211/74; 211/188; 211/194

[58] Field of Search ..... 211/74, 71, 194, 188, 211/75, 126, 189; 220/23.6; 206/509, 511

[56] References Cited

U.S. PATENT DOCUMENTS

| | | | |
|---|---|---|---|
| 3,746,178 | 7/1973 | Wagschal | 211/74 |
| 4,093,076 | 6/1978 | Newton | 211/74 |
| 4,099,626 | 7/1978 | Magnussen, Jr. | 211/194 X |
| 4,270,662 | 6/1981 | Gonzalez | 211/74 |
| 4,422,555 | 12/1983 | Jacobs | 211/74 |
| 4,660,727 | 4/1987 | Levine | 211/74 |
| 4,799,592 | 1/1989 | Hessmert | 220/23.6 X |

*Primary Examiner*—Blair M. Johnson
*Attorney, Agent, or Firm*—Parmelee, Bollinger & Bramblett

[57] ABSTRACT

One or more bottle-holding rack components which may be interconnected and assembled to form a bottle rack and the like are each provided in the shape of a cradle having an upper bottle cradling surface and a plurality of upstanding legs each of which contain a joint element on the outer surface thereof and on the upper extremity of each of the upstanding legs. Interconnecting members are provided extending laterally on each side of the upper bottle cradling surface and are adapted to form an interconnection between adjacently-positioned bottle rack components. Each joint element on the upper and outer extremity of each leg are adapted to form a joint connection between complementary joint elements of adjacently-positioned bottle rack components whereby when adjacently-positioned bottle rack components are inconnected, three spaced joints are formed between the adjacently-connected components. Receptacles are positioned on the lower surface of the cradle for receiving a pair of joined upstanding legs which permits the positioning of bottle rack components on top of any adjacently-interconnected pair of bottle rack components thereby allowing the construction of a bottle rack assembly which is adapted to extend vertically as well as horizontally in a large variety of shapes and configurations.

13 Claims, 5 Drawing Sheets

BOTTLE RACK COMPONENT AND ASSEMBLY

Each bottle rack component is a singular unit with all of the joint elements and interconnecting members being formed therein thereby requiring no interconnecting members or other parts to permit the assembly of a multiple bottle holding rack. Each component may be used singularly or in combination without additional parts and further, are so constructed that they may be conveniently and compactly stacked one within the other for convenient handling, packing and shipping.

FIELD OF THE INVENTION

This invention relates to a bottle rack component and assembly for holding bottles, such as wine bottles and the like, and more particularly to a one piece bottle rack component which may be used individually or in combination with a plurality of the same components forming a readily assemblable and disassemblable bottle rack which may be conveniently assembled in a wide variety of shapes and configurations adapted to house a plurality of bottles in a configuration conforming to the storage space available.

BACKGROUND OF THE INVENTION

Many approaches have been taken for constructing bottle racks which are primarily used for storing wine in a recommended inclined position. In U.S. Pat. No. 3,746,178 a modular knock-down wine rack is provided which includes a plurality of end members which are interconnected by bars or interconnecting pieces. In U.S. Pat. No. 4,422,555 a plurality of elongated support members are interconnected by a plurality of struts and in U.S. Pat. No. 4,270,662 identical modular members are provided and used in pairs. In all these configurations a number of interconnecting members or a plurality of parts are required which complicates assembly and disassembly and also makes it difficult to store the variety of parts in a convenient fashion so that when reassembly is required all the parts will be available. In other words, the more or smaller the parts, the more readily they may be misplaced or lost making assembly, disassembly, storage and reassembly a difficult problem. In addition, the requirement of a large number of parts may be more expensive as well as more difficult to configure in the shape desired. Then to, if all of the component parts are not used in a given configuration, they must be stored. None of the configurations illustrated, for example, in the aforesaid patents may be conveniently and compactly stored or stacked in a compact configuration until reused.

A good bottle rack will also be characterized as being sufficiently strong to support a large or varying number of bottles at any given time. Whether one or say twenty (20) bottles are being supported, the bottles should be supported such that they cannot fall through the rack from one position to another, or are not adequately supported regardless of the number of bottles provided. Accordingly, a substantially full cradle or supporting surface is believed essential in order to fairly distribute the weight of the bottle along the entire surface and also to make it easy to both insert and remove a stored bottle from the rack.

SUMMARY OF THE INVENTION

Accordingly, it is an object of this invention to provide a new and improved bottle-holding component system in which single unitary elements may be utilized individually or in combination to form a bottle rack of practically limitless configuration and arrangement to accommodate its assemblage in a particular area.

A further object of this invention is to provide a new and improved modular bottle rack component and assembly for storing bottles, such as wine bottles and the like, formed from unitary single component parts which may be assembled and disassembled easily and yet may be stored in a stacked configuration for completely compacting a disassembled bottle rack assembly.

Another object of this invention is to provide a new and improved bottle rack component and assembly for the storing of bottles, such as wine bottles and the like, which is simple, easy to assemble and disassemble and is cost-effective for storing a large number of bottles in a desired configuration to fit any particular storage area.

Still a further object of the present invention is to provide a new and improved bottle rack which has individual cradle surfaces for supporting a bottle in an inclined position over substantially the entire surface of the bottle thereby insuring not only the support but the easy removal or replacement of the bottle in its particular cradle.

Still a further object of this invention is to provide a new and improved rack component assembly which is stable and which when the components are assembled in a bottle rack is sufficiently strong to support a large number of filled bottles.

In carrying out this invention in one illustrative embodiment thereof, one or more bottle rack components may be used individually or may be assembled to form a bottle rack. Each rack component has a cradle having an upper bottle-cradling surface and a lower surface with a plurality of upstanding legs. A joint element is provided on an outer surface of each extremity of upstanding legs and are adapted to form a joint connection between a complementary joint element of an adjacently positioned rack component. An interconnecting member extending laterally on each side of the upper bottle-cradling surface is adapted to form an interconnection between adjacently positioned rack elements. A receptacle means is positioned on the lower surface of each cradle which is adapted to hold a pair of upstanding legs which have been joined in order to permit the positioning of bottle rack components vertically one over other horizontally joined components.

BRIEF DESCRIPTION OF THE DRAWINGS

The invention, together with further objects, advantages, aspects and features thereof will be more clearly understood from the following description taken in connection with the accompanying drawings in which like elements bear the same reference numerals throughout the various views.

DESCRIPTION OF THE PREFERRED EMBODIMENTS

Although the rack components and assembly of the present invention are particularly useful and described in connection with the storage of wine bottles, and may be referred to as a wine rack component or wine rack assembly or simply wine rack, it will be apparent that the modular rack construction can be utilized for the storage of any type of bottles or other items where a modular compartmentized arrangement is found desirable. Accordingly, the use of the terms "wine" and "wine rack" are not considered to limit the invention strictly to the storage of wine bottles.

Figure 1:
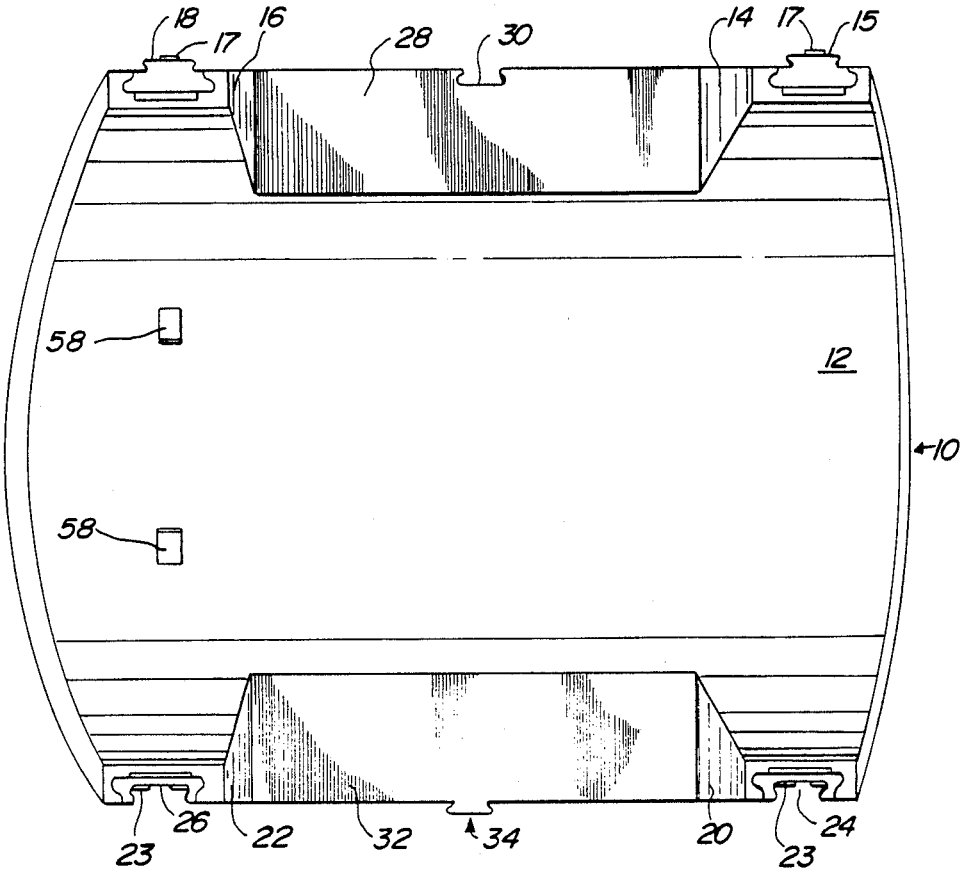
FIG. 1 is a top elevational view of a bottle rack component in accordance with the present invention.
Figure 4:
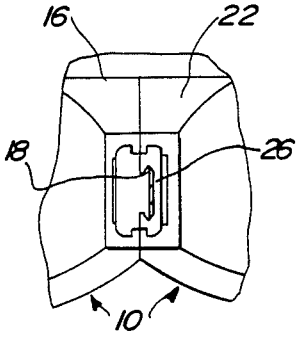
FIG. 4 is a top view of the male and female top interlock elements on the upstanding legs of the bottle rack component shown engaged.
Figure 2:
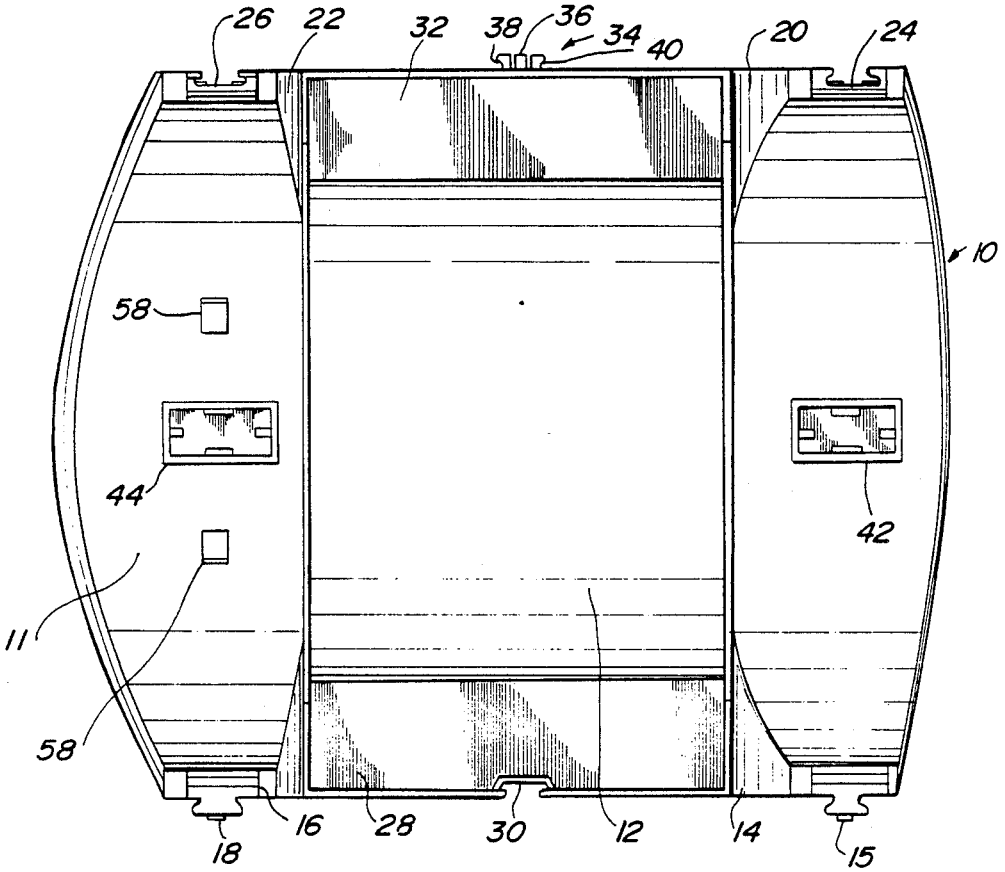
FIG. 2 is a bottom view of the bottle rack component illustrated in FIG. 1.
Figure 3:
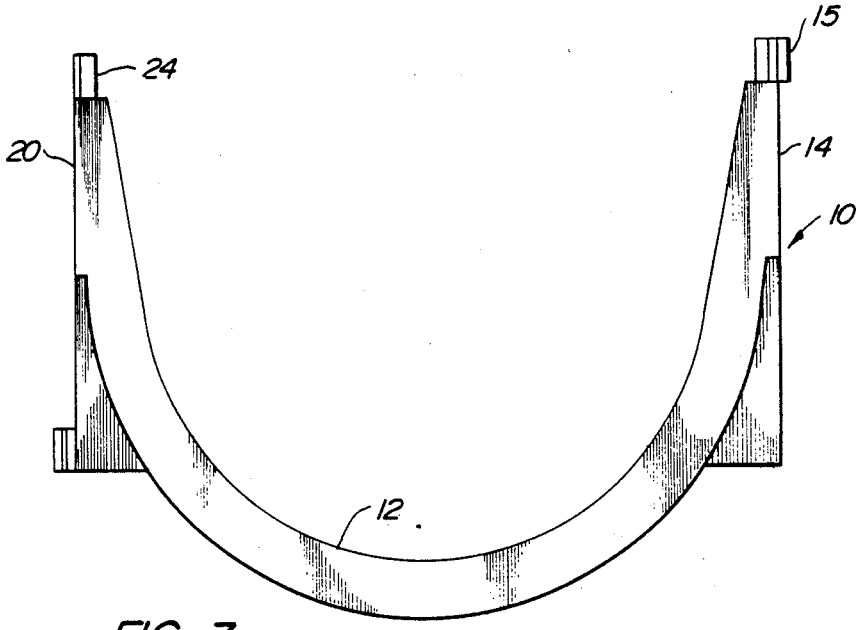
FIG. 3 is a side elevational view of the bottle rack component illustrated in FIGS. 1 and 2.

Referring now to FIGS. 1-3, a unitary integral bottle rack component, referred to generally with the reference numeral 10, is provided as will best be seen in FIG. 3 with a generally U-shaped cradle 12 adapted to accommodate the holding of a wine bottle (not shown) in a generally horizontal reclining position. If desired, the cradle may be partially open. The cradle 12 has a first pair of upstanding legs 14 and 16 thereon having male joint elements 15 and 18 thereon respectively forming joint elements on the outer surface and upper extremity of the upstanding legs 14 and 16. A second pair of upstanding legs 20 and 22 are positioned on the opposite side of the cradle 12 from the first pair of legs 14 and 16. The legs 20 and 22 contain complementary joint elements 24 and 26 in the form of female sockets or mortises which are adapted to receive male joint elements 15 and 18 of an adjacently positioned wine rack component 10. The male joint elements 15 and 18 are extensions in the form, for example, of tenons illustrated as having trapezoidal heads which precisely fit in complementary fashion by a sliding movement either upwardly or downwardly into the female receptacles 24 and 26, respectively. FIG. 4 illustrates the male tendon 18 fitting into the female mortise 26 forming a top interlock between leg 16 and 22 of adjacently positioned rack units or components 10. Anti-blocking members 17 for elements 15 and 18 and members 23 in female receptacles 24 and 26 form an anti-blocking system which facilitates assembly and disassembly of the interconnected joints formed thereby.

Although the particular interlock of the joint elements shown is formed by an upward or downward sliding movement of the male and the female members, other types of joint elements may be utilized e.g. snap-action joint elements for providing an interlock between the upper extremities of a pair of legs. In accordance with the present invention, the type of joint elements 15 and 18 and 24 and 26 are not important; however, the male interlock element should be positioned in alignment on one side on the upper extremities of the legs and the female joint element should be positioned on the opposite pair of legs in horizontal alignment with each other as well as horizontal alignment with the male members so that a one unit 10 can be readily joined with another unit or component 10.

It should be pointed out the rack component 10 is illustrated in a preferred form having two legs on each side, however, component 10 could be constructed with one or more legs on each side.

As will best be seen in FIGS. 1 and 2, a lateral shelf 28 having a female receptacle 30 centrally located therein extends laterally from the cradle 12 between the upstanding legs 14 and 16. Another laterally-extending shelf 32 having a male resilient side interlock element 34 extending therefrom which is complementary with the female side receptacle 30 extends between the upstanding legs 20 and 22. The male and female complementary interconnecting members 30 and 34 are in alignment on their respective shelves such that on adjacent component 10 is adapted to be interconnected with an adjacent rack component 10 providing a side interlock between two rack components 10 in horizontal alignment. The male side interconnecting member 34 is illustrated in the form of a central post 36 being flanked by resilient ears 38 and 40 which are designed to interlock with the female interconnecting member 30 (See FIG. 2) in which the indentations between 36, 38 and 40 extend only half way in order to facilitate a sliding connection between interconnecting member 30 and 34. It should be understood that other types of interconnection can be made e.g., a bayonet type insertion with the male member 34 snapping into the female side interconnecting member 30.

Accordingly, when two rack components or units 10 are aligned horizontally and interconnected they are interlocked at three points on either side of the cradle 12. The three interlocks are at the top, front and rear and lower middle as represented by the joint elements 24, 26 and interconnecting joint elements 15, 18 and interconnecting members 30 and 34. The three interlocking positions for connecting the units 10 together provide strength and stability as well as facilitating ease of assembly and disassembly of interconnected components 10.

Figure 5:
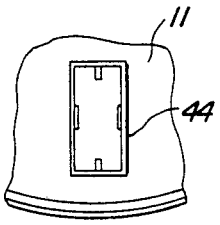
FIG. 5 illustrates the receptacle means on the undersurface of the cradle of the bottle rack element which is adapted to accommodate the reception of the top interlock engaged legs as illustrated in FIG. 4 or a single leg.
Figure 6:
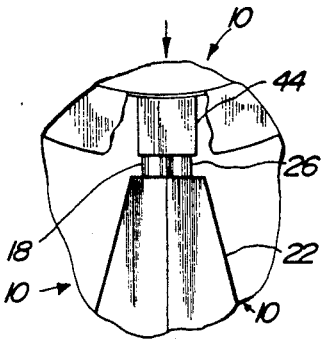
FIG. 6 is a front view illustrating the receptacle means being pushed down for holding the engaged top male and female interlocks and accordingly, not only ensures holding the interlock legs together but permits the vertical positioning and retention of ,rack components vertically.

As will best be seen in FIG. 2 on the bottom view of the rack component 10, the bottom surface 11 includes a receptacle means in the form of aligned clamp boxes 42 and 44 as will best be seen in FIGS. 2 and 5 which are adapted to hold the male and female top interlocks as illustrated in FIG. 4 in locked together relationship. If only one leg is employed, the clamp boxes could hold only one leg. FIG. 6 illustrates a front view of the clamp box 44 being pushed down over the male joint element 18 on leg 16 which has been joined with the female element 26 on the leg 22 to form an interlock which is clamped together by positioning a third rack component 10 on top of the two joined components 10.

Figure 7:
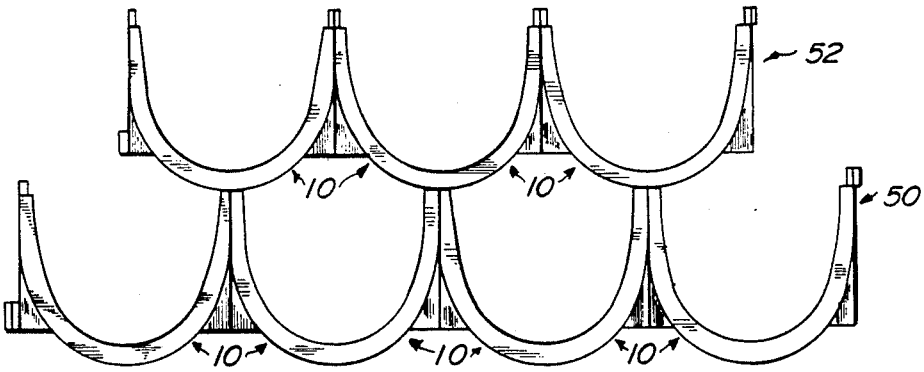
FIG. 7 illustrates one form of assembled rack components forming a bottle rack in one configuration.

As will best be seen in FIG. 7, a plurality of rack components 10, four in number are interconnected horizontally in a first horizontal alignment row 50. Three additional units 10 are interconnected in a second horizontal alignment row 52. Two pairs of interconnected legs forming the upper interlocks in row 50 are positioned and mounted vertically in the clamp boxes 42 and 44. The clamp boxes can also receive one leg if row 52 is wider than row 50. Accordingly, horizontal as well as vertical stacking is readily accommodated. The units 10 may be formed in a large variety of horizontal and vertical configurations. The upper horizontal row 52 may extend beyond row 50 by the extent of one additional unit 10 on either end and an innumerable number of units may be arranged horizontally in the bottom row or a variety of pyramidal arrangements may be made with the next row having two units and so on. Any number of arrangements and configurations may be made to accommodate longitudinal and/or vertical arrangements or a combination of each which ultimately will be defined by the storage space which is available. The interconnection of the units 10 which are interconnected at three points on each horizontal interconnection and are mounted at least two aligned points by the clamp boxes 44 and 42, provide symmetry and strength in the interconnected units. The two slide end type interlocks as well as one bayonet-type interlock provide diversity and ease of interconnection as well as strength in the interconnected arrangements.

Figure 8B:
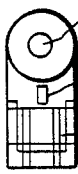
FIG. 8B is a front view of FIG. 8A.
Figure 8A:
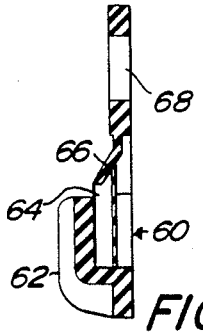
FIG. 8A is a side elevation view partly in section of a hanger clip which may be used with the bottle rack components of the present invention to provide additional support and stability for an assembled rack.
Figure 8C:
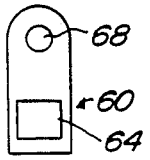
FIG. 8C is a rear view of FIG. 8A.

In order to add extra stability if desired or required, a small hanger clip 60 is provided as shown in FIG. 8 which is adapted to be mounted on a wall by any suitable means such as a screw, nail, etc. The hanger clip has a upstanding tongue 62 forming a recess 64 therein for receiving the downwardly extending flange wall 13 of the rack component 10 (See FIG. 10). A tab 66 over the recess 64 bears on the flange 13 when the flange is inserted in the recess to aid in retaining the rack component 10 in the hanger clip 60. An upper opening 68 is provided for attaching the hanger clip 60 to a wall or suitable support.

Figure 9:
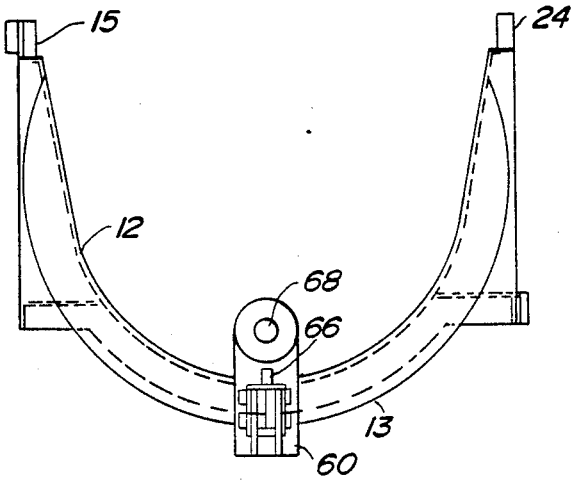
FIG. 9 is a front view illustrating the clip in FIG. 8 having a bottle rack component position therein.
Figure 10:
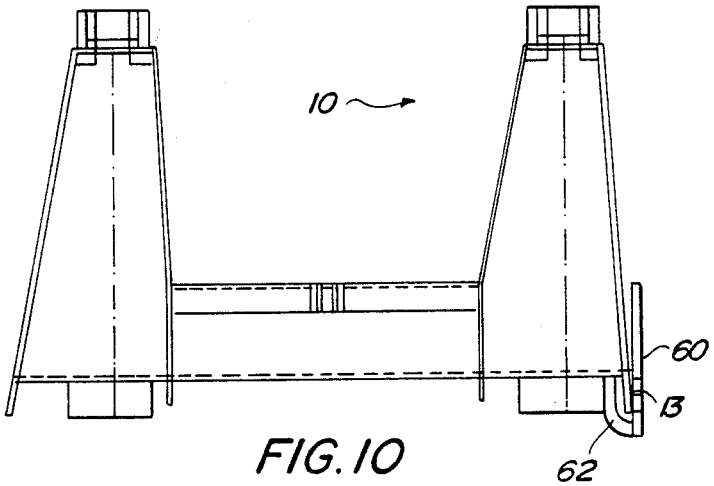
FIG. 10 is a side view of FIG. 8 showing the bottle rack component hanging in the support clip.

As seen in FIGS. 9 and 10, the hanger clip is mounted at the rear of the rack component 10 with the rack component hanging in the clip 60 and retained therein by the upstanding tongue 62. The clip 60 will normally be used to connect a cradle 12 of a bottle rack component to a wall when the assembled rack extends upwardly and becomes high in order to provide extra stability. However, the clip may be used with any type of assemblage as desired.

Figure 11:
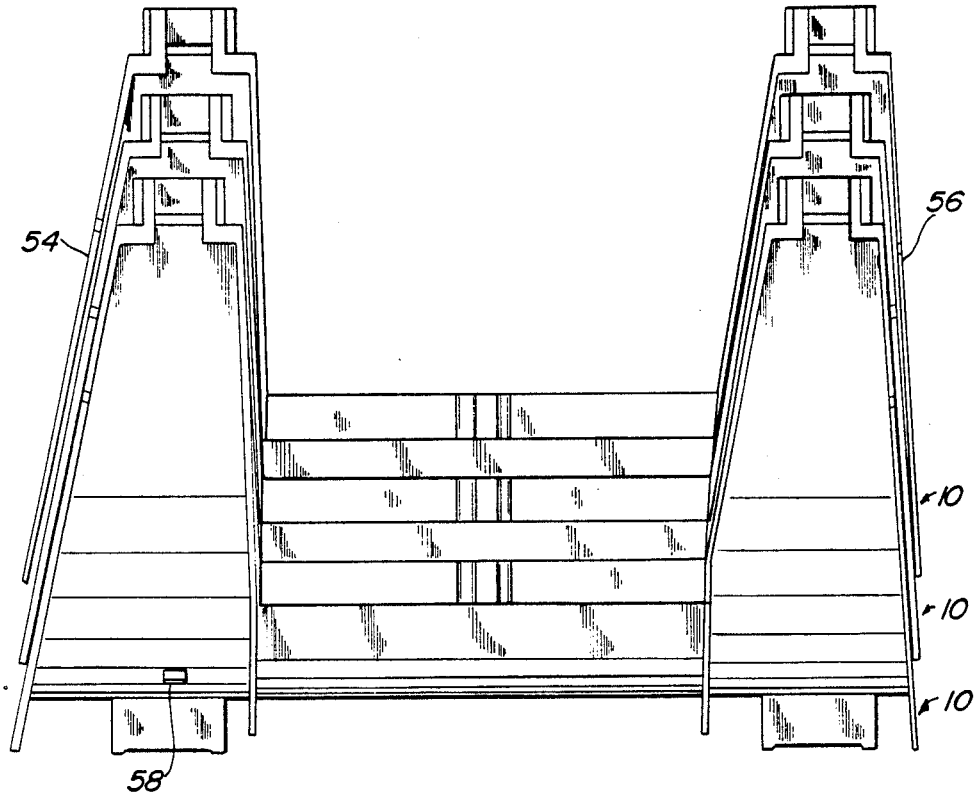
FIG. 11 is a side elevational view of a plurality of rack component which are stacked vertically for convenience of storage while not in use.

As will be seen in FIG. 11, the individual rack components or units 10 may be compactly stacked one within the other for convenience storage when not in use or shipping. The individual units 10 have a front surface 54 having an angle which differs from the angle of the rear surface 56 such that the racks cannot be stacked wrong. A pair of indicator holes 58 are positioned between the rear leg 16 and 22 in the cradle 12 (see FIG. 1) which are adapted to receive small rubber components to prevent bottles from sliding in the cradles. These rubber components (not shown) can easily be inserted (without glue or other retainers) by the user. The hole 58 will also remind the user of the proper stacking alignment.

The wine or bottle rack assembly in accordance with the present invention, is advantageous in its unitary construction consisting of one piece which may be interconnected with one or more of the same unitary components thereby simplifying the manufacturing as well as assembly. The wine or bottle rack can be assembled in various configurations for different space availability and/or to accommodate different numbers of bottles. As a bottle is removed, its individual cradle can also be removed if desired. More sections can be added or removed providing flexibility in numbers as well as configuration. The various components or units are interconnected from the upstanding leg portions of all four outer and upper extremities on opposite sides between the upstanding legs. In addition, the interconnecting upstanding legs when joined together fit into receptacle means in the form of clamp boxes of the bottom side of the cradle to permit interconnected vertical stacking. The three interlock connections on each side as well as the clamping of the connections together for vertical stacking in the clamp boxes provide not only stability but strength in the interconnections. The configuration of the individual components also permit vertical stacking for storage and the convenient handling of the assembly and disassembly of the units.

It should be pointed out that a single module may have two or more cradles rather than the preferred single cradle. Each module may also have one or three or more legs on each side if desired, rather than the preferred two legs on each side.

Since other changes and modifications varied to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. In a bottle rack which may include one or more bottle rack components, each of said rack components comprising:

a cradle having an upper bottle cradling surface with a plurality of upstanding legs and a lower surface said upstanding legs having upper ends;

a joint element on an outer surface and upper extremity of each of said upstanding legs adapted to form a joint connection between a complementary joint element of an adjacently positioned bottle rack component;

an interconnecting member extending laterally on each side of said upper bottle cradling surface adapted to form an interconnection between adjacently positioned bottle rack components; and a receptacle means positioned on the lower surface of said cradle adapted to receive the upper ends of a pair of upstanding legs which have been joined in order to permit the positioning of bottle rack components vertically one over other horizontally joined components.

2. In the bottle rack as claimed in claim 1 wherein said plurality legs comprise two pair of legs on each extremity of said cradle with the opposite pairs having the same type of joint element and each pair of legs having different types of joint elements which opposite pairs are complementary so that adjacent opposite pairs of joint elements may be assembled and disassembled.

3. In the bottle rack as claimed in claim 2 wherein one of said pairs of joint elements are tenons and the other joint elements are mortises.

4. In the bottle rack as claimed in claim 1 wherein one of said interconnecting members is a socket and the other interconnecting member includes a complementary resilient male member.

5. In the bottle rack as claimed in claim 1 wherein said interconnecting members are positioned in a laterally extending shelf.

6. In the bottle rack as claimed in claim 1 wherein said receptacle means is positioned near opposite ends of said cradle and are in horizontal alignment with said joint elements on said legs.

7. A bottle rack having one or more one piece rack units, each unit comprising:

a cradle having an upper bottle cradling surface for supporting a bottle in said cradle substantially along the entire contents containing portion of the bottle being positioned therein;

a first and a second pair of legs extending upwardly and in alignment on opposite sides of said cradle, said legs having upper ends;

a first joint element on an upper and outer extremity of each of said first pair of legs;

a second joint element on an upper and outer extremity of each of said second pair of legs in alignment with said first joint elements on said first pair of legs;

said second joint elements being complementary with said first joint elements whereby the first and second joint elements form a joint connection therebetween when joined thereby forming an interlock between said first and second pair of legs of adjacently positioned rack units when interconnected;

a receptacle means on the underside of said cradle for receiving and holding the upper ends of a pair of legs forming a joint connection between units for mounting units vertically on units which have been horizontally interlocked.

8. The bottle rack as claimed in claim 7 wherein said first joint elements are tenons and said second joint elements are mortises.

9. The bottle rack as claimed in claim 7 having first and second interconnecting members on opposite sides of said cradle intermediate said first and second pairs of legs which are complementary and adapted to provide an interconnection with an adjacently positioned rack unit.

10. The bottle rack as claimed in claim 9 wherein said first interconnecting member is a socket and second interconnecting member is a male member which is adapted to interlock with said first interconnecting member.

11. The bottle rack as claimed in claim 9 wherein said first and second interconnecting members are positioned in laterally extending shelves extending outwardly from said cradle.

12. In the bottle rack as claimed in claim 1 wherein said cradle of said rack component has a downwardly extending flange, a hanger clip having a receptacle formed with an upwardly extending tongue adapted to receive said flange on said cradle whereby said rack component is adapted to hang in said hanger clip to provide support and stability for a bottle rack formed with said bottle rack components.

13. The bottle rack as claimed in claim 7 wherein the cradle of each of said rack units has a downwardly extending flange, at least one hanger clip having a receptacle formed with an upwardly extending tongue adapted to receive said flange on said cradle whereby said rack component is adapted to hang in said hanger clip to provide support and stability for a bottle rack formed with said bottle rack components.

* * * * *